US008984780B2

(12) United States Patent
Brassell et al.

(10) Patent No.: US 8,984,780 B2
(45) Date of Patent: Mar. 24, 2015

(54) EDGE-LIT LIGHT ENGINE MODULE FOR SIGNS AND SIGN

(71) Applicant: GE Lighting Solutions, LLC, East Cleveland, OH (US)

(72) Inventors: Robert J Brassell, East Cleveland, OH (US); Jeffrey Nall, East Cleveland, OH (US); Christian Auger, Lachine (CA)

(73) Assignee: GE Lighting Solutions, LLC, East Cleveland, OH (US)

( * ) Notice: Subject to any disclaimer, the term of this patent is extended or adjusted under 35 U.S.C. 154(b) by 0 days.

(21) Appl. No.: 13/721,364

(22) Filed: Dec. 20, 2012

(65) Prior Publication Data

US 2013/0199065 A1 Aug. 8, 2013

Related U.S. Application Data

(60) Provisional application No. 61/595,336, filed on Feb. 6, 2012.

(51) Int. Cl.
*G09F 13/18* (2006.01)
*G09F 13/22* (2006.01)

(52) U.S. Cl.
CPC ..... *G09F 13/18* (2013.01); *G09F 2013/222* (2013.01)
USPC ..... 40/546

(58) Field of Classification Search
USPC ..... 40/546
See application file for complete search history.

(56) References Cited

U.S. PATENT DOCUMENTS

| | | | | |
|---|---|---|---|---|
| 1,139,723 | A * | 5/1915 | Rich | 40/546 |
| 6,305,109 | B1 * | 10/2001 | Lee | 40/546 |
| 6,341,440 | B1 * | 1/2002 | Lee | 40/546 |
| 6,471,388 | B1 | 10/2002 | Marsh | |
| 6,481,130 | B1 * | 11/2002 | Wu | 40/546 |
| 6,539,657 | B1 * | 4/2003 | Qualls et al. | 40/546 |
| 6,615,520 | B2 * | 9/2003 | Landers et al. | 40/546 |
| 6,705,033 | B1 * | 3/2004 | Greene et al. | 40/546 |
| 7,182,492 | B1 * | 2/2007 | Walter | 362/497 |
| 7,226,195 | B2 * | 6/2007 | Rapeanu et al. | 362/559 |
| 7,246,932 | B2 * | 7/2007 | Burtsev et al. | 362/616 |
| 7,287,347 | B2 * | 10/2007 | Hasan | 40/553 |
| 7,681,347 | B1 | 3/2010 | Welker et al. | |
| 7,774,965 | B2 * | 8/2010 | Lee | 40/570 |
| 7,810,262 | B2 * | 10/2010 | Sadon | 40/546 |
| 2002/0007576 | A1 * | 1/2002 | Gai | 40/546 |
| 2002/0157292 | A1 * | 10/2002 | Landers et al. | 40/546 |
| 2003/0192216 | A1 * | 10/2003 | Hsu | 40/570 |
| 2004/0095741 | A1 * | 5/2004 | Chen | 362/31 |
| 2006/0265919 | A1 * | 11/2006 | Huang | 40/546 |
| 2007/0245607 | A1 * | 10/2007 | Awai et al. | 40/546 |
| 2008/0285274 | A1 * | 11/2008 | Jung | 362/240 |
| 2009/0229154 | A1 * | 9/2009 | Sadon | 40/546 |
| 2010/0107462 | A1 * | 5/2010 | Lee | 40/546 |

* cited by examiner

*Primary Examiner* — Gary Hoge
(74) *Attorney, Agent, or Firm* — GE Global Patent Operation; Peter T. DiMauro

(57) ABSTRACT

An edge-lit light engine module for signs and a sign are provided. The light engine module has housing and a light engine that fits within the housing. The housing has a base member and at least one side member that overlaps a tab formed along an edge of a sign face. The housing is configured to align the light engine with the partial edge of the sign so that light from the light engine enters and is reflected within the material that forms the sign face so that the sign face becomes illuminated. The housing properly aligns the light engine, and also serves as a heat sink to draw heat away from the light engine and transfer the heat outside the housing.

6 Claims, 4 Drawing Sheets

EDGE-LIT LIGHT ENGINE MODULE FOR SIGNS AND SIGN

BACKGROUND OF THE INVENTION

1. Field of the Invention

The field of the invention relates to signage generally, and more particularly to certain new and useful advances in the application of energy-efficient light emitting diodes (LEDs) to signs and displays.

2. Description of Related Art

Various configurations exist for illuminating a sign or a display. For example, front-lit signs are illuminated using one or more light sources that are exterior to the sign. Back-lit signs are illuminated using one or more light sources, most commonly fluorescent bulbs, which emit light by ionizing mercury vapor. The ionized mercury vapor emits ultraviolet light. The ultraviolet light impinges a phosphor coated on the inside of the fluorescent bulb, causing the phosphor to fluoresce, giving off light. Non-electrical signs are illuminated using a radioluminescent material such as tritium. Some signs form graphics and/or words out of a tube that is filled with a gas, such as neon, argon or krypton. The gas emits light when electrical energy passes from an electrode at one end of the tube through the gas to an electrode at the other end of the tube.

More recently, edge-lit signs have been developed. These illuminate flat, thin sign faces by inputting light from multiple edges of the sign face. One or more LEDs can be used as light sources, but due to heat and physical design constraints, but those used tend to be low-power LEDs. Moreover, such LEDs typically have a fixed geometry that is sized for a specific sign face size or application.

BRIEF SUMMARY OF THE INVENTION

The present disclosure describes embodiments of a module that can be used to illuminate a sign or a display and a sign using such a module. The module includes a base member, two opposing side members coupled to the base member forming a channel therebetween and a light engine configured to fit within the channel that includes at least one light source. The channel is configured to receive a partial edge of the planar sign. The opposing side members have at least one attachment element capable of connecting the module to the partial edge of the planar sign. The light source may include at least one light emitting diode (LED). The attachment element aligns the light engine at a predetermined position relative to the partial edge of the planar sign. The planar sign includes a light guide. The attachment element, such as through holes, tabs, or locating fingers, aligns the light engine at a predetermined distance from the light guide, which provides close tolerance matching between the light engine and the light guide. Examples of the attachment elements include a tab, a through hole, and a locating finger.

In another embodiment, a sign is provided. The sign includes a planar sign face, a light guide coupled to the planar sign face and a housing. The housing includes a channel to receive a partial edge of the planar sign face and a light engine configured to fit within the channel and having at least one light source. At least one attachment element connects the housing to the partial edge of the planar sign face, at a predetermined position relative to the top edge of the light guide, facilitating internal reflection of the light source within the planar sign face. The position may be a predetermined distance between the at least one light source and the top edge of the light guide. The light guide is only attached to a partial edge of the planar sign face.

In yet another embodiment, a sign is provided. The sign includes a planar sign face having a first, set of through holes formed there through, a light guide with at least one edge coupled to the planar sign face, and a housing. The housing includes two opposing side members having a second set of through holes, a base member coupled with the two opposing side members forming a channel therebetween where the channel is dimensioned to receive a partial edge of the planar sign face and a light engine configured to fit within the channel which has at least one light emitting diode (LED). The first and second set of through holes are aligned such that the at least one LED is disposed at a predetermined position from the top edge of the light guide to facilitate internal reflection of light emitted from the LED within the planar sign face. The predetermined position may be the distance between the at least one LED and the top edge of the light guide.

Other features and advantages of the disclosure will become apparent by reference to the following description taken in connection with the accompanying drawings.

BRIEF DESCRIPTION OF THE SEVERAL VIEWS OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION OF THE INVENTION

Figure 1:
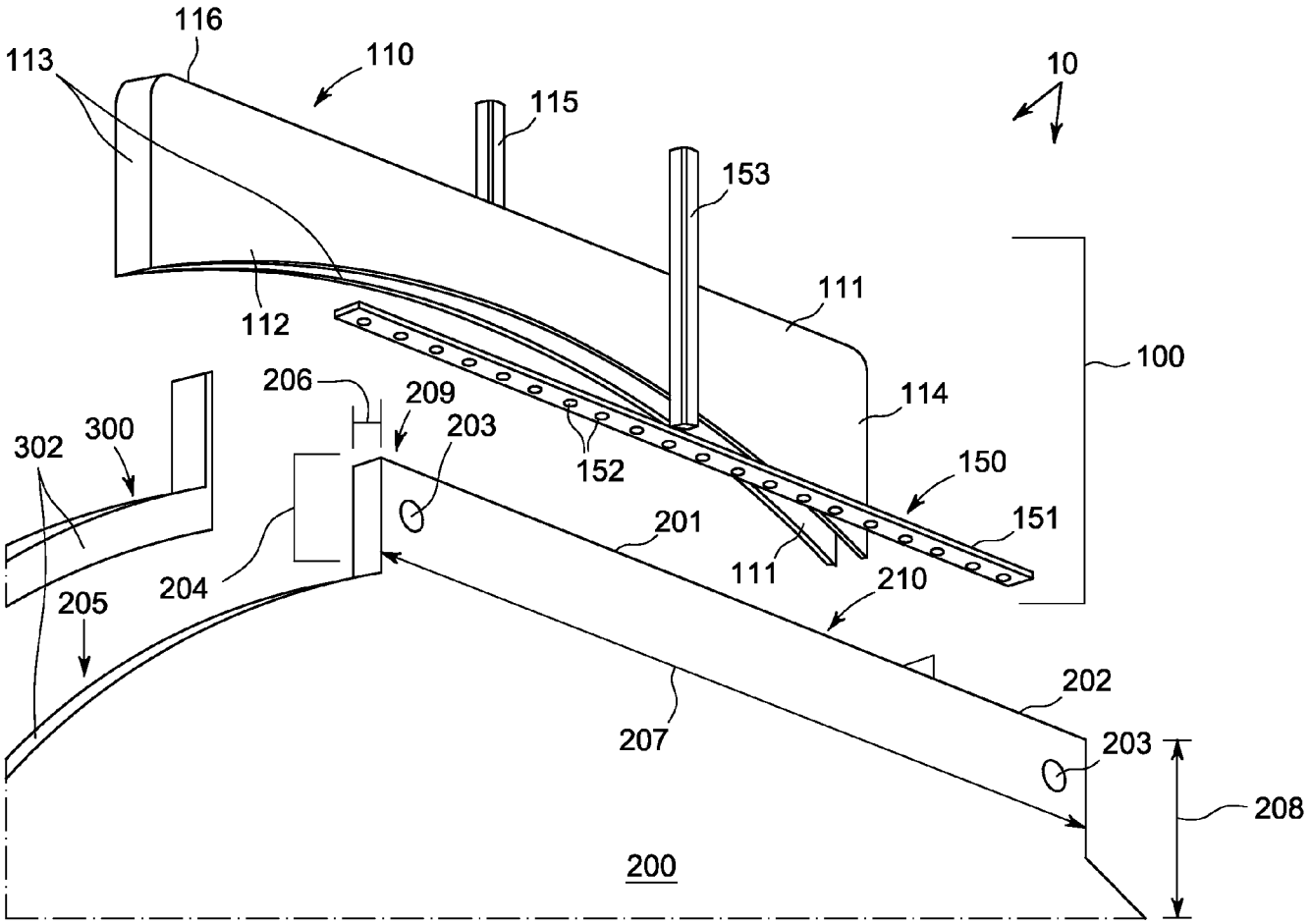
FIG. 1 is an exploded perspective view of an embodiment of a kit comprising an edge-lit light engine module and a display.

Reference will now be made in detail to the embodiments consistent with the invention, examples of which are illustrated, in the accompanying drawings. In describing particular features of different embodiments of the present invention, number references will be utilized in relation to the figures accompanying the specification. Similar or identical references in different figures may be utilized to indicate similar or identical components among different embodiments of the invention.

The subject matter of the invention relates to a sign face is plastic or other clear or filled polymer material that can transmit and internally reflect light. The sign face surface has a coating or features that permits light to exit with a desired intensity, pattern or location. Additionally, the sign body may contain a structure embedded therein to reflect light within the sign body and/or to permit light to exit the sign surface and/or the embedded structure. The sign face may be planar. An edge-lit light engine module couples with the sign face.

The light engine module comprises At least one light source or a linear array of light sources mounted on a circuit board substrate. This substrate is mounted within a housing, formed of a heat-conductive material that serves as a heat sink and protective enclosure. The enclosure captures at least a partial edge of the sign face, and serves to overlap and reflect the light source/sign interlace at a specific position to facilitate internal light reflection. This overlap position may vary depending on the wattage of light sources used, the type of material that comprises the sign face, etc. The housing includes an attachment element or fastener such as a through hole, a tab, or locating finger used to mount, attach, or position the sign face. These attachment element(s) are dimensioned to provide close tolerance matching such that the edge of the sign face or the light guide attached to or within the sign face is precisely located with respect to the light engine within the housing. However, the housing can be coupled with the sign face using other types of fastening techniques, such as bonding, gluing and/or fixturing.

Advantageously and in contrast to prior approaches, the housing need not encompass an entire side or large area of the sign face, but rather mounts or attaches to only a partial edge of the sign face, using a tab or other attachment mechanism. The edge lit modular configuration of this housing and light engine combination permits fixed, specifically located and controlled light entry into the sign face. Moreover, this modular configuration ensures consistent fitting or light source placement with respect to the light source/sign interface. The physical size and dimensions of the light engine module are typically smaller than the physical size and dimensions of the sign face to which it is coupled.

Other advantages over prior approaches include that the housing and light engine substrate interface serve as a heat sink, permitting the use of high output LEDs. This heat dissipation, which is improved relative to prior approaches, ensures a full service life. The light engine module can be scaled and configured for application on circular sign face disks, rectangular disks or irregular shapes. Material thickness may vary as required. The module locating fasteners serve to carry the load of the larger, heavier sign face and can be used as mounting provisions. The edge-lit light engine module is remotely powered resulting in compact size and a visually appealing installation. The edge lit housing assembly is versatile, and can be a stand-alone product. Moreover, a single standard size unit may be used to illuminate a variety of sizes or diameters of signs.

Figure 2:
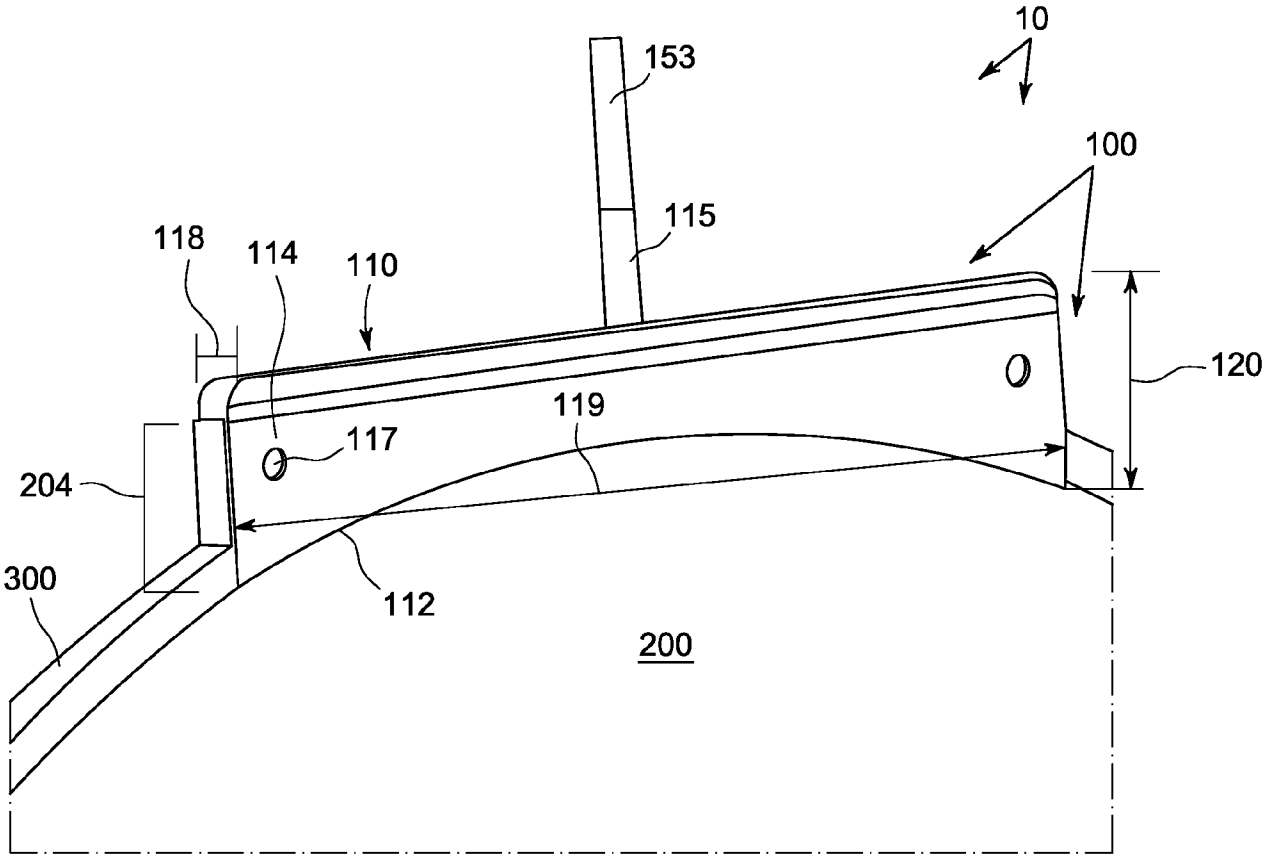
FIG. 2 is a perspective view of the kit of FIG. 1 in an assembled state.
Figure 3:
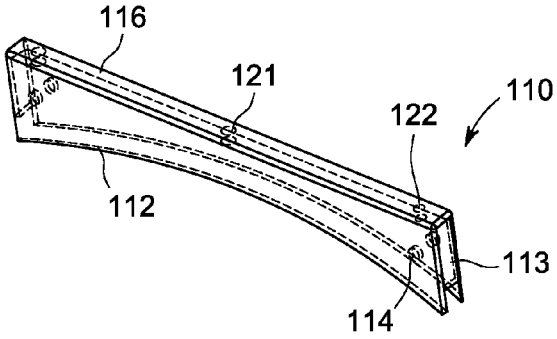
FIG. 3 is a perspective view an embodiment of the housing of FIG. 1.

FIG. 1 is an exploded perspective view of an embodiment of a kit 10 comprising light engine module 100 and a sign face 200. FIG. 2 is a perspective view of the kit 10 of FIG. 1 in an assembled state. FIG. 3 is a perspective view an embodiment of the housing 110 of FIG. 1

Referring to FIGS. 1, 2 and 3, the light engine module 100 comprises a housing 110 and a light engine 150. The light engine module 100 can be manufactured and sold as a stand-alone unit or manufactured and sold with the sign face 200. In either case, the light engine module 100 houses the light engine 150 and aligns the light engine 150 at a predetermined position with and/or spacing from a portion of the partial edge of the planar sign or the top edge of light guide 210. The predetermined position facilitates an optimal transfer of light from the light engine 150 to the sign face 200. The light guide is a clear, translucent or partially filled acrylic, polycarbonate or glass material through which light is distributed and subsequently extracted from. The predetermined position may be a specific distance between the top edge of light guide 210 and the light engine 150. The light engine module 100 also supports the sign face 200 via one or more fasteners 117. The fasteners can be, for e.g., pins, rivets or bolts that fit in one or more aligned attachment element such as through holes 114, 203. Through holes 114 are formed in the housing 110. Through holes 203 are formed in the tab 204 of the sign face 200. Additionally, the housing 110 of the light engine module 100 draws heat from the light engine 150 and dissipates the heat into the surrounding environment.

As shown in FIG. 2, the housing 110 of the light engine module 100 has a predetermined thickness 118, length 119 and width 120. The housing 110 is formed of an opaque material having a high thermal conductivity. Examples of such materials include, but are not limited to aluminum alloys, copper, and composite materials. As shown in FIG. 1, one or more side members 111 of the housing 110 overlap the partial edge of the sign face 200 or tab 204 of the sign face 200 containing a light guide 210. This overlap causes light from the light engine 150 entering the tab 204 to be reflected and/or diffused throughout the entire sign face 200. Without this overlap, a significant portion of light from the light engine 150 would immediately escape the tab 204. The one or more side members 111 have smooth outer surfaces, but can include textured or finned outer surfaces to improve transfer of heat from the light engine 150 to the environment. The components of the housing 110, e.g., base member 116 and one or more side members 111, can be integrally formed or alternatively formed as individual components and pieced together.

As shown in FIGS. 1 and 2, the housing 110 comprises a base member 116 that is coupled with at least one side member 111. Two side members 111 are used for two-sided signs, and are positioned to form a channel 113 therebetween. The channel 113 is configured or dimensioned to receive (or slide over) the light engine 150 and a portion of the sign face 200, such as the light guide 210, partial edge of the sign or tab 204. At least the interior surfaces of the side members 111 of the channel 113 can be highly polished and/or lined with an optically reflective material to facilitate transfer of light from the light engine 150 to the sign face 200. In one embodiment, the portion of the sign face 200 that fits within the channel 113 of the housing 110 of the light engine module 100 is a tab 204 containing a light guide 210. The tab 204 containing a light guide 210 is coupled to the sign face 200 or integrally formed. Each side member 111 has a leading edge 112. Either or both of the leading edges 112 are straight or formed in an aesthetically pleasing shape. The side members 111 are dimensioned to cover the light engine 150 and to overlap the tab 204 or light guide 210 of the sign face 200. This arrangement facilitates an efficient transfer of light from the light engine 150 to the edge 201 of the tab 204 or light guide 210 of the sign face 200.

Figure 4:
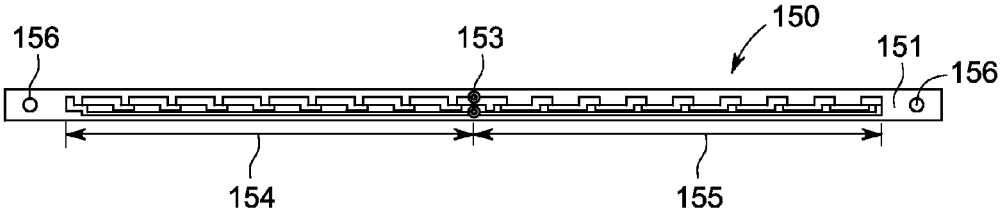
FIG. 4 is a plan view of the light engine of FIG. 1, with LEDs removed to show circuit traces.
Figure 5:
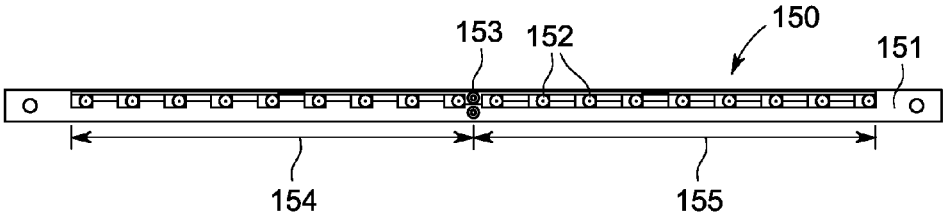
FIG. 5 is another plan view of the light engine of FIG. 1, with a plurality of LEDs installed.

As shown in FIGS. 4 and 5, the light engine 150 comprises a substrate 151 on which one or more series or parallel circuits are formed. These circuits, which may use either constant current or constant voltage, power one or more light sources 152. The light sources 152 are high-power light emitting diodes (LEDs). High-power LEDS may be used, for example, LEDs configured to use about 500 milliwatts to about 10 watts or more in a single package. The light sources 152 may be flat LED packages, with or without lenses or covers. If light sources 152 equipped with lenses or covers are used, such lenses or covers may fit within one or more receptacles formed in the tab 204. A thermal interface material may be disposed between a surface of the substrate 151 and an interior surface of the base member 116 of the housing 110 of the light engine module 100.

As shown in FIG. 3, a hole 121 is formed in the base member 116 of the housing 110. A first tube 115 is aligned with the hole 121 and coupled with the base member 116. A second tube 153 is coupled with the substrate 151 of the light engine 150, as shown in FIGS. 1 and 2, for example. The second tube 153 has a smaller diameter than the first tube 115, and fits within the first tube 115 when the light engine 150 is positioned in the housing 110. The second tube 153 contains one or more electrical leads that supply power to the one or mom circuits that are formed on the substrate 151. One or more through holes 122 can be formed in the base member 116 to align with through holes 156 (FIGS. 3 and 4) in the substrate 151 of the light engine 150.

The sign face 200 may be formed of any material that can contain and reflect light from within it. Examples of materials that can be used to form the sign face 200 include, but are not limited to: acrylic, polycarbonate, glass, quartz crystal, vinyl (PVC), clear aerylonitrile butadiene styrene (ABS) and polyethylene terephthalate (PET) [make sure these are spelled out somewhere]. The sign face 200 has any desired 2D or 3D shape, and is configured or viewing from either one side or two sides. When configured for one-sided viewing, the sign face 200 has a reflective material or treatment applied to at least its back surface and/or edge 205. When configured for two-sided viewing, the sign face 200 has a reflective material or treatment 302 applied to its edge 205 (FIG. 1). In either case, the reflective material or treatment 302 functions to prevent light emitted into the interior of the sign face 200 from escaping from the back surface and/or edge 205. For example, the edge 205 and/or back surface of the sign face 200 may be highly polished. As another example, optically reflective tape may be applied to the edge 205 of the sign face 200 or to a surface of an edgeband 300. As another example, a surface of the edgeband 300 may be highly polished and/or have an optically reflective finish.

The sign face 200 has at least one tab 204 containing a light guide 210 formed along an edge 201 thereof. Unlike the edge(s) 205 of the sign face 200, the edge 201 of the tab 204 does not have an optically reflective material 302 applied to it. Instead, the edge 201 of the tab 204 is configured to receive light emitted from the light engine module 100. At least the tab 204 of the sign face 200 has a predetermined thickness 206, length 207, and width 208, which generally match the corresponding thickness 118, length 119 and width 120 of the light engine module 100. The corners 209 of the tab 204 may be shaped or otherwise designed to scatter and diffuse light emitted from the light engine module 100. One or more through holes 203 are formed in the tab 204 at positions that correspond to the positions of through holes 114 formed in the housing 110 of the light engine module 100. Although round through holes 203 and 114 are illustratively shown, the through holes 203 and 114 may have any suitable cross-sectional shape. Like the through holes 114 formed in the housing 110 of the light engine module 100, the through holes 203 are positioned to be between the light engine 150, and the edge 201 of the tab 204, and the body of the sign face 200. As noted above, the edge 201 of the tab 204 can have one or more receptacles formed therein into which the one or more light sources 152 fit.

The thickness 118, length 119 and width 120 of the light engine module 100, the housing 110, the light engine 150 and/or the tab 204 will vary depending on a number of factors, such as the number of lumens per square foot to be reflected through one or both surfaces 202 of the sign face 200, the dimensions of the sign face 200, the wattage, type and/or configuration of the light sources) 152, etc. Typically, each side member 111 has a length greater than its width, and a thickness that, is less than its width. In one embodiment, the light engine module 100 is configured to produce about 250 lumens to about 500 lumens per square foot of the sign face 200. This exemplary output range is anticipated to increase over time.

FIG. 4 is a plan view of the light engine 150 of FIG. 1, with LEDs removed to show the circuit traces 156. FIG. 5 is another plan view of the light engine 150 of FIG. 1, with a plurality of LEDs 152 installed. Referring to FIGS. 4 and 5, the linear substrate 151 comprises a central power connection located in the second tube 153. Two series circuits 154 and 155 are disposed on either side of the central power connection located in the second tube 153. A plurality of light sources 152 are coupled with the series circuits 154 and 155.

Figure 6:
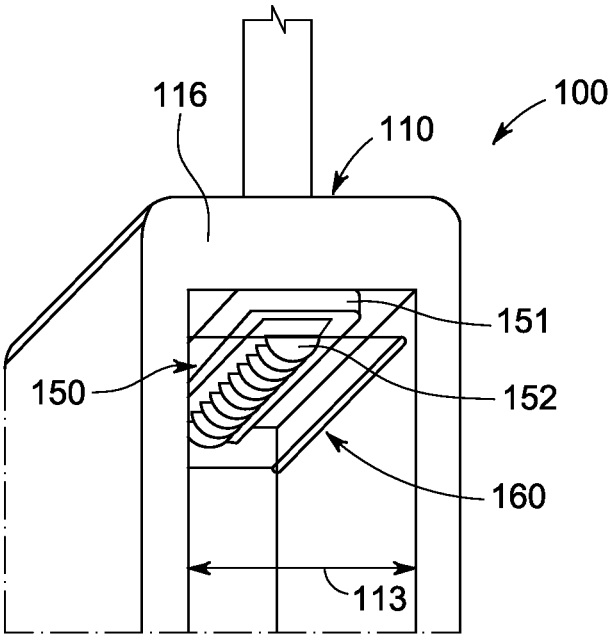
FIG. 6 is a side view of the edge-lit light engine module of FIG. 1.
Figure 7:
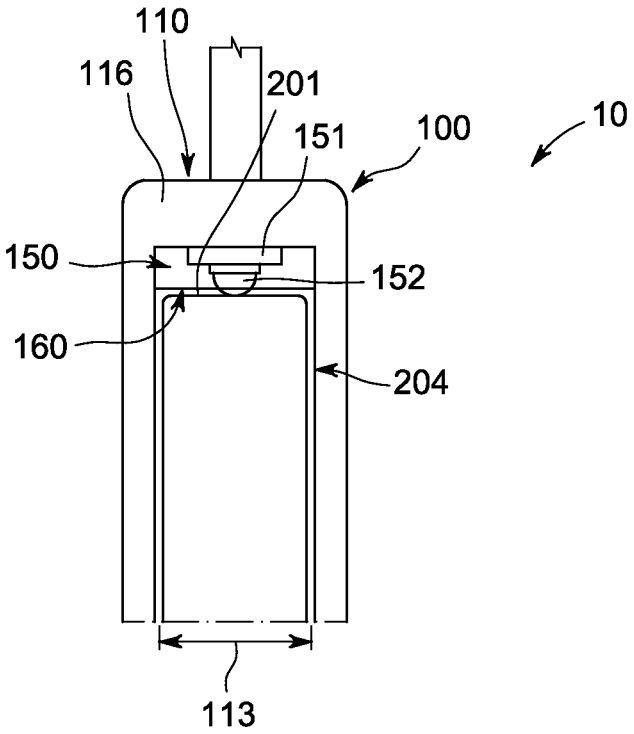
FIG. 7 is a side view of the kit of FIGS. 1 and 2 in an assembled state.

FIG. 6 is a side view of the edge-lit light engine module 100 of FIG. 1. FIG. 7 is a side view of the kit 10 of FIGS. 1 and 2 in an assembled state. FIG. 6 shows the channel 113 empty, and the light engine 150 fitted against the base member 116, as previously described. The light engine 150 includes the substrate 151 and the light source(s) 152, FIG. 7 shows the channel 113 fitted around the partial edge or tab 204 of the sign face 200 (not shown in FIG. 6/7) so that the edge 201 of the tab 204 contacts the light source 152 without stressing it. This is merely one embodiment of the invention. For example, there may also be a gap between the partial edge of the sign face 200 and the light source(s) 152. As mentioned above, the edge 201 of the tab 204 may have one or more receptacles (not shown) formed therein to receive the light source lens or housing.

As shown in FIGS. 6 and 7, the light engine module 100 may further comprise a seal 160 that makes the light engine module 100 weatherproof. The seal 160 is a clear potting material, sealant or gasket that encapsulates the light engine 150 within the housing 110. If a gasket is used, it may be equipped with holes that correspond to the location(s) of the light source(s) 152 so that contact between the light source(s), and/or their lenses or housings, and the edge 201 of the tab 204 can be achieved. The channel 113 can be configured so that the clear material that forms the seal 160 flows up and around the edge of the tab 204.

Referring to FIGS. 1,2, 3, 4 and 5, an edge-lit light engine module 100 may be assembled using the following steps, in any suitable order and/or in parallel, unless otherwise noted. The housing 110 is formed of a material having a high thermal conductivity. A portion of an inner surface of one or both side members 111 is configured to be optically reflective. The through hole(s) 114 are marked and/or bored. Optionally, the power conduit hole 121 is formed through the base member 116, and the tube 115 is aligned with the power conduit hole 121 and coupled with the base member 116. The power leads of the light engine 150 are fitted through the power conduit hole 121. A thermal interface material is applied to an inner surface of the base member 116 and/or to a back surface of the substrate 151 of the light engine 150. The light engine 150 is positioned adjacent the inner surface of the base member 116 and fasteners, bolts, rivets, screws, etc., are fitted through the through holes 156 in the substrate 151 and the aligned through holes 122 in the base member to secure the light engine 150 in place and ensure a good thermal bond between the base member 116, the substrate 151 and/or the thermal interface material. A weatherproofing gasket may be added.

An illuminated sign is assembled using the following steps, in any suitable order, unless otherwise noted. A sign face 200 is cut or molded in a desired shape and may have a tab 204. An assembled edge-lit light engine module is positioned to cover, or enclose, the tab 204. If the through holes 114 and 203 have already been formed, they are aligned and secured with fasteners 117. Otherwise, the through holes 114 and 203 are formed using a computer numerical control (CNC) machine equipped with computer assisted design (CAD) or other software that specifies the location and positioning of the through holes 114 and 203. Then the fasteners 117 are fitted into the aligned through holes 114 and 203 to secure the edge-lit light engine module 100 to the sign face 200. In this manner, the light engine 150 is precisely aligned and positioned relative to the edge 201 of the tab 204 of the sign face 200, for example at a predetermined distance.

In operation, current from a power source (not shown) flows through the power leads to the series circuits 154 and 155, and from, the series circuits 154, 155 to the light, sources 152, which illuminate and emit light. This emitted light is transferred across the substrate/sign interface and into the thickness of the material that forms the sign face 200. Thereafter, the light is internally reflected so that it traverses and illuminates the sign face 200 to a desired intensity (lumens per square foot, or equivalent).

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

What is claimed is:

1. A sign comprising:

a planar sign face, said planar sign face having a reflective material applied to an edge thereof;

a tab comprising a light guide coupled to the planar sign face, the tab comprising a top edge (201);

a housing comprising:

a channel configured to receive the top edge (201) of the tab and a partial edge of the planar sign face; and a light engine configured to fit within the channel and comprising at least one light source; and at least one attachment element connecting the housing to the partial edge of the planar sign face, wherein the attachment element aligns the at least one light source at a predetermined position relative to the top edge.

2. The sign of claim 1, wherein the predetermined position between the light source and the top edge of the tab facilitates internal reflection of the light source within the planar sign face.

3. The sign of claim 1, wherein the at least one attachment element positions the at least one light source at a predetermined distance from the top edge of the tab.

4. The sign of claim 1, wherein the light guide is only attached to a partial edge of the planar sign face.

5. A sign comprising:

a planar sign face;

a tab comprising a light guide coupled to the planar sign face, the tab comprising a top edge (201) and having a first set of through holes formed therethrough; and a housing comprising:

two opposing side members having a second set of through holes, at least a portion of an inner surface of the two opposing side members configured to be optically reflective;

a base member coupled with the two opposing side members forming a channel therebetween, the channel dimensioned to receive a partial edge of the planar sign face; and a light engine configured to fit within the channel comprising at least one light emitting diode (LED), wherein the first and second set of through holes are aligned such that the at least one LED is disposed at a predetermined position from the top edge (201) of the tab to facilitate internal reflection of light emitted from the at least one LED within the planar sign face.

6. The sign of claim 5, wherein the first and second set of through holes are attached using one or more fasteners.

* * * * *